US008447577B2

(12) United States Patent
Fujiwara

(10) Patent No.: US 8,447,577 B2
(45) Date of Patent: May 21, 2013

(54) STEAM-USING FACILITY SIMULATION SYSTEM AND METHOD FOR SEARCHING APPROACH FOR IMPROVING STEAM-USING FACILITY

(75) Inventor: Yoshiyasu Fujiwara, Kakogawa (JP)

(73) Assignee: TLV Co., Ltd., Hyogo (JP)

( * ) Notice: Subject to any disclaimer, the term of this patent is extended or adjusted under 35 U.S.C. 154(b) by 549 days.

(21) Appl. No.: 12/674,023

(22) PCT Filed: Aug. 4, 2008

(86) PCT No.: PCT/JP2008/063957
§ 371 (c)(1),
(2), (4) Date: May 5, 2010

(87) PCT Pub. No.: WO2009/025165
PCT Pub. Date: Feb. 26, 2009

(65) Prior Publication Data

US 2011/0060567 A1 Mar. 10, 2011

(30) Foreign Application Priority Data

Aug. 23, 2007 (JP) ..... 2007-217238

(51) Int. Cl.
*G06E 9/455* (2006.01)

(52) U.S. Cl.
USPC ..... 703/7; 700/288

(58) Field of Classification Search
USPC ..... 703/2, 6, 7; 700/286, 288; 60/772, 60/782; 376/317; 705/7; 340/605; 702/183
See application file for complete search history.

(56) References Cited

U.S. PATENT DOCUMENTS

| | | | | |
|---|---|---|---|---|
| 4,628,462 | A * | 12/1986 | Putman | 700/288 |
| 5,347,466 | A * | 9/1994 | Nichols et al. | 703/18 |
| 2001/0053992 | A1* | 12/2001 | Eto et al. | 705/7 |
| 2002/0133270 | A1* | 9/2002 | Hung et al. | 700/286 |
| 2003/0046939 | A1* | 3/2003 | Hyakutake et al. | 60/782 |
| 2005/0150230 | A1* | 7/2005 | Rollins | 60/772 |
| 2006/0200325 | A1* | 9/2006 | Hayashi | 703/2 |
| 2007/0057802 | A1* | 3/2007 | Fujiwara | 340/605 |
| 2007/0104306 | A1* | 5/2007 | Umezawa et al. | 376/317 |
| 2007/0204623 | A1* | 9/2007 | Rollins, III | 60/772 |
| 2008/0249744 | A1* | 10/2008 | Fujiwara | 702/183 |

FOREIGN PATENT DOCUMENTS

| | | |
|---|---|---|
| JP | 02002408 | 1/1990 |
| JP | 2002122005 A | 4/2002 |
| JP | 2005114366 A | 4/2005 |
| JP | 2005115456 A | 4/2005 |
| JP | 2005325765 A | 11/2005 |
| JP | 2007133596 A | 5/2007 |

* cited by examiner

*Primary Examiner* — Kandasemy Thangavelu
(74) *Attorney, Agent, or Firm* — The Webb Law Firm

(57) ABSTRACT

A steam-using facility simulation system for efficiently searching for an approach for improving a steam-using facility that is effective in overall improvement of a steam-using facility and a method for searching for an approach for improving a steam-using facility are provided. The system includes storage means configured to store steam usage state information of the steam-using facility; input means to which facility improving approach information of the steam-using facility is input; simulating means configured to compute predicted steam usage state information of the steam-using facility after implementation of the improving approach based on the steam usage state information of the steam-using facility stored in the storage means and the facility improving approach information input to the input means; and output means configured to output the predicted steam usage state information of the steam-using facility computed by the simulating means.

20 Claims, 7 Drawing Sheets

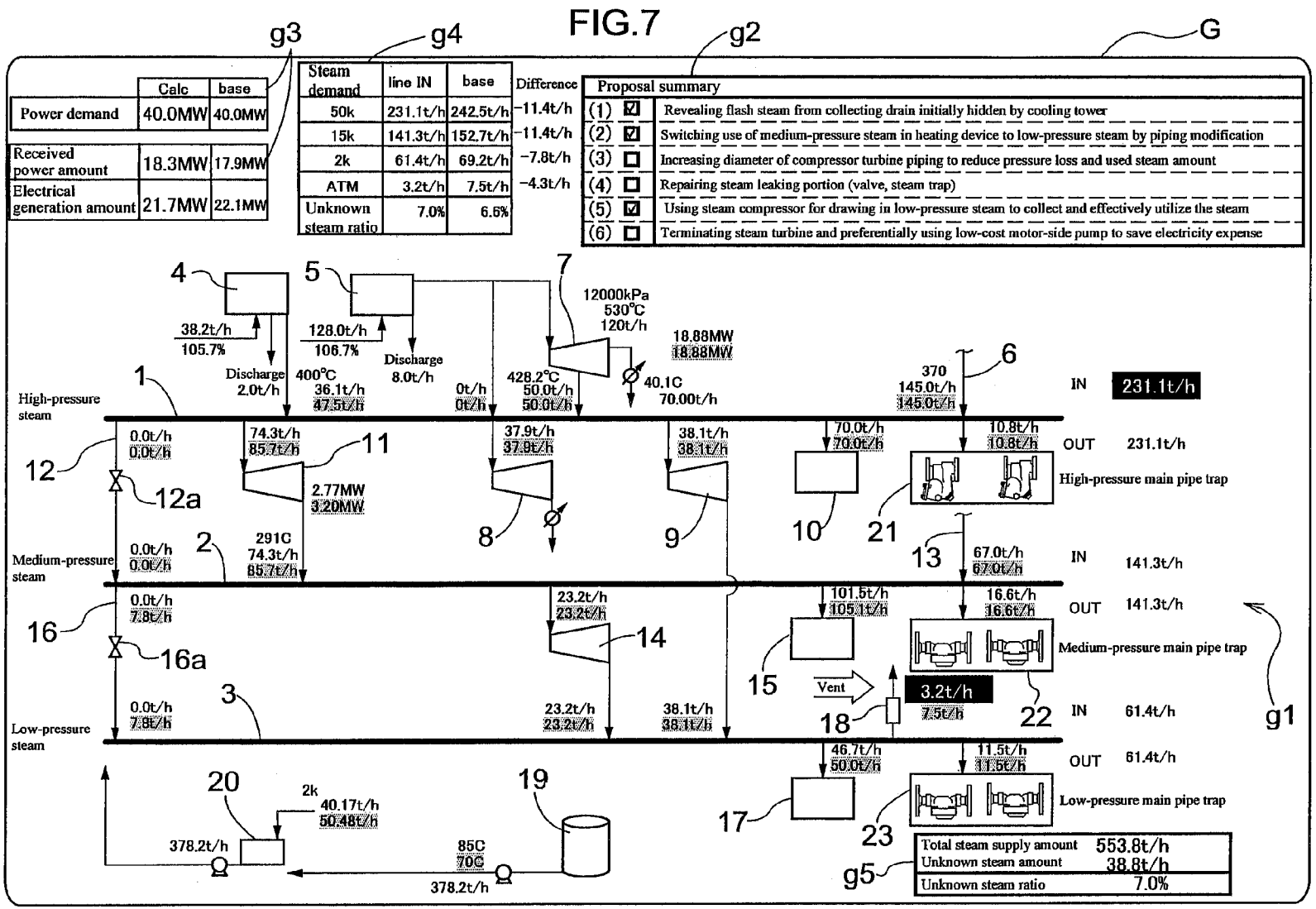
FIG.7
G
g1
g2
g3
g4
g5
Proposal summary
(1) ☑ Revealing flash steam from collecting drain initially hidden by cooling tower
(2) ☑ Switching use of medium-pressure steam in heating device to low-pressure steam by piping modification
(3) ☐ Increasing diameter of compressor turbine piping to reduce pressure loss and used steam amount
(4) ☐ Repairing steam leaking portion (valve, steam trap)
(5) ☑ Using steam compressor for drawing in low-pressure steam to collect and effectively utilize the steam
(6) ☐ Terminating steam turbine and preferentially using low-cost motor-side pump to save electricity expense
Steam demand | line IN | base | Difference
50k | 231.1t/h | 242.5t/h | −11.4t/h
15k | 141.3t/h | 152.7t/h | −11.4t/h
2k | 61.4t/h | 69.2t/h | −7.8t/h
ATM | 3.2t/h | 7.5t/h | −4.3t/h
Unknown steam ratio | 7.0% | 6.6%
Power demand | Calc 40.0MW | base 40.0MW
Received power amount | 18.3MW | 17.9MW
Electrical generation amount | 21.7MW | 22.1MW
High-pressure steam
Medium-pressure steam
Low-pressure steam
High-pressure main pipe trap
Medium-pressure main pipe trap
Low-pressure main pipe trap
IN 231.1t/h
OUT 231.1t/h
IN 141.3t/h
OUT 141.3t/h
IN 61.4t/h
OUT 61.4t/h
Total steam supply amount 553.8t/h
Unknown steam amount 38.8t/h
Unknown steam ratio 7.0%
Vent
3.2t/h
12000kPa 530℃ 120t/h
18.88MW
40.1C 70.00t/h
428.2℃ 50.0t/h
400℃ 36.1t/h
128.0t/h 106.7%
38.2t/h 105.7%
Discharge 8.0t/h
Discharge 2.0t/h
2.77MW
291C 74.3t/h
85C 70C
378.2t/h
40.17t/h
2k
370 145.0t/h
10.8t/h
67.0t/h
16.6t/h
11.5t/h
70.0t/h
101.5t/h
46.7t/h
38.1t/h
37.9t/h
23.2t/h
74.3t/h
0.0t/h
7.8t/h
1
2
3
4
5
6
7
8
9
10
11
12
12a
13
14
15
16
16a
17
18
19
20
21
22
23

STEAM-USING FACILITY SIMULATION SYSTEM AND METHOD FOR SEARCHING APPROACH FOR IMPROVING STEAM-USING FACILITY

TECHNICAL FIELD

The present invention relates to a steam-using facility simulation system used for searching an appropriate facility improving approach for a steam-using facility, such as chemical plant, and a method for searching an approach for improving a steam-using facility.

BACKGROUND ART

For this type of method for searching an approach for improving a steam-using facility, as one conventional example, there can be mentioned a method in which the facility improving approach includes replacing or repairing a steam trap, including steps of: diagnosing a present steam trap provided in the steam-using facility; based on a diagnosis result, computing a trap-passed steam loss amount for the entire steam-using facility due to trap defect or the like, by means of arithmetic addition; computing a possible reduction amount in the trap-passed steam loss amount that would be obtained by implementing the facility improving approach, by means of arithmetic addition; computing a predicted total steam supply amount after implementation of the improving approach by subtracting the reduction amount in the trap-passed steam loss amount from a present total steam supply amount of the steam-using facility; and determining whether or not the facility improving approach is appropriate, based on a magnitude of the predicted total steam supply amount after implementation of the improving approach (see Patent Document 1 below).

Patent Document 1: Japanese Unexamined Patent Application No. 2005-114366A

DISCLOSURE OF THE INVENTION

However in general, in the steam-using facility, after high-pressure steam generated in a boiler or the like is used in a steam-using device or the like, the used steam is reused as medium-pressure or low-pressure steam in another steam-using device, and thus a steam usage state as a whole becomes complicated. Therefore, in the case of the conventional technique in which the predicted total steam supply amount after implementation of the facility improving approach is calculated merely by subtracting a reduction amount in the trap-passed steam loss amount obtained by implementation of the facility improving approach from a present total steam supply amount of the steam-using facility, there are disadvantages that accuracy of the predicted total steam supply amount itself becomes poor, and effects of the facility improving approach on the steam-using facility cannot be fully examined. This further leads to inaccurate evaluation regarding whether or not the facility improving approach is appropriate, and thus there arises a problem that it is difficult to search for a facility improving approach that is effective in overall improvement of the steam-using facility.

In view of the above, the main object of the present invention is to provide a steam-using facility simulation system for efficiently searching for a facility improving approach that is effective in overall improvement of a steam-using facility and a method for searching for an approach for improving a steam-using facility.

In a first aspect of the present invention, there is provided a steam-using facility simulation system including: storage means configured to store steam usage state information of a steam-using facility; input means to which facility improving approach information of the steam-using facility is input; simulating means configured to compute predicted steam usage state information of the steam-using facility after implementation of an improving approach based on the steam usage state information of the steam-using facility stored in the storage means and the facility improving approach information input to the input means; and output means configured to output the predicted steam usage state information of the steam-using facility computed by the simulating means.

According to the present configuration, the predicted steam usage state information of the steam-using facility after implementation of the improving approach computed by the simulating means is output by the output means, based on the steam usage state information of the steam-using facility stored in the storage means and the facility improving approach information input to the input means. Accordingly, based on the simulation result that has been output, one can accurately assess effects of the implementation of the facility improving approach on the complicated steam usage state of the steam-using facility. Therefore, it becomes possible to efficiently search for a facility improving approach that is effective in overall improvement of the steam-using facility.

In a second aspect of the present invention, the simulating means is configured to compute the predicted steam usage state information of the steam-using facility after implementation of the improving approach based on multiple pieces of the facility improving approach information input to the input means.

According to the present configuration, simulation results can be obtained with respect to a plurality of the facility improving approaches. Accordingly, for example, by comparing the plurality of the simulation results, merits and demerits of each facility improving approach can be elucidated. Therefore, a request of an owner, manager or the like of the steam-using facility can be easily affected, and accordingly, it becomes possible to further efficiently search for a facility improving approach that is effective in overall improvement of the steam-using facility.

In a third aspect of the present invention, the simulating means is configured to select one or more pieces of the facility improving approach information from among multiple pieces of the facility improving approach information input to the input means, and to compute the predicted steam usage state information of the steam-using facility after implementation of the improving approach based on the selected facility improving approach information.

According to the present configuration, simulation results can be obtained with respect to arbitrarily selected facility improving approaches, while eliminating a facility improving approach that is not required to be simulated, such as a facility improving approach which cannot be implemented due to a contract or the like by the owner, manager or the like of the steam-using facility, from a subject of the search, among a plurality of the facility improving approaches. Therefore, it becomes possible to efficiently search for a facility improving approach that is effective in overall improvement of the steam-using facility.

In a fourth aspect of the present invention, the simulating means is configured to combine multiple pieces of the facility improving approach information input to the input means to obtain combined facility improving approach information, and to compute the predicted steam usage state information of the steam-using facility after implementation of the improving approach based on the combined facility improving approach information.

According to the present configuration, the combined facility improving approach obtained by combining multiple pieces of the facility improving approach information input to the input means is a subject of the simulation, and thus variations in the facility improving approach which is a subject of the simulation can be increased. Therefore, it becomes possible to further efficiently search for a facility improving approach that is effective in overall improvement of the steam-using facility.

It should be noted that the multiple pieces of the facility improving approach information to be combined into the combined facility improving approach information are not limited to all of the multiple pieces of the facility improving approach information input to the input means, and alternatively, they may be a portion selected from the multiple pieces of the facility improving approach information input to the input means.

In a fifth aspect of the present invention, the output means is configured to output the facility improving approach information by category used in the computation by the simulating means and at the same time the predicted steam usage state information of the steam-using facility computed by the simulating means.

According to the present configuration, one can assess both the facility improving approach information by category used in the computation by the simulating means and the predicted steam usage state information of the steam-using facility computed by the simulating means at the same time. Therefore, for example, a search for the facility improving approach can be effectively prevented from becoming inappropriate, which may otherwise be caused by error in correspondence relationship between the facility improving approach and the predicted steam usage state information.

In a sixth aspect of the present invention, the output means is configured to output multiple pieces of the facility improving approach information by category input to the input means in such a manner that a piece of the facility improving approach information by category used in the computation by the simulating means from among multiple pieces of the facility improving approach information by category input to the input means is distinguishable.

According to the present configuration, one can assess the predicted steam usage state information of the steam-using facility computed by the simulating means, in consideration of evaluation or the like of the facility improving approach used in the computation by the simulating means among a plurality of the facility improving approaches input to the input means. Therefore, it becomes possible to further efficiently search for a facility improving approach that is effective in overall improvement of the steam-using facility.

In a seventh aspect of the present invention, the output means is configured to output the steam usage state information of the steam-using facility stored in the storage means and at the same time the predicted steam usage state information of the steam-using facility computed by the simulating means.

According to the present configuration, one can assess both the steam usage state information and the predicted steam usage state information at the same time. Therefore, for example, one can effectively identify portions with changes and portions without changes in terms of the used steam amount or the like before and after implementation of the facility improving approach, and it becomes possible to further efficiently search for a facility improving approach that is effective in overall improvement of the steam-using facility.

In an eighth aspect of the present invention, there is provided a method for searching for an approach for improving a steam-using facility including steps of diagnosing the steam-using facility, and based on a diagnosis result, conducting a current situation survey on the steam-using facility for assessing a steam usage state of the steam-using facility; assuming a facility improving approach to be realized based on the steam usage state of the steam-using facility assessed through the current situation survey on the facility, and conducting an improving simulation for simulating a predicted steam usage state of the steam-using facility after implementation of the facility improving approach; and searching for an appropriate facility improving approach based on the predicted steam usage state of the steam-using facility obtained by the improving simulation.

According to the present configuration, with respect to the facility improving approach assumed based on the steam usage state of the steam-using facility assessed through the current situation survey on the facility, after conducting an improving simulation for simulating a predicted steam usage state of the steam-using facility after implementation of the facility improving approach, an appropriate facility improving approach is searched based on the predicted steam usage state of the steam-using facility obtained by the improving simulation. Accordingly, one can accurately assess effects of the implementation of the facility improving approach on a complicated steam usage state of the steam-using facility. Therefore, it becomes possible to efficiently search for a facility improving approach that is effective in overall improvement of the steam-using facility.

In a ninth aspect of the present invention, any one of the following is assessed as the steam usage state of the steam-using facility through the current situation survey:

(a) whether or not a steam supply pressure is appropriate from a viewpoint of an entire balance of the steam-using facility; (b) whether or not a steam supply method is appropriate; (c) how a discharge of water of vapor condensation is performed; and (d) whether or not the water of vapor condensation is effectively fed to a recycling system including a boiler.

To put it another way, by assessing the item (a), for example an improving approach such as reducing steam supply pressure can be assumed to be realized; by assessing the item (b), for example an improving approach such as changing the steam supply method or the like can be assumed to be realized; by assessing the item (c), for example, an improving approach such as reciprocally changing a steam trap and a valve or the like can be assumed to be realized; and by assessing the item (d), for example an improving approach such as changing a feeding channel for water of vapor condensation or the like can be assumed to be realized.

To sum up, according to the present configuration, the improving approach which has a high effect on the steam usage state of the steam-using facility can be assumed to be realized, and thus it becomes possible to further efficiently search for a facility improving approach that is effective in overall improvement of the steam-using facility.

In a tenth aspect of the present invention, in the improving simulation, the predicted steam usage state of the steam-using facility after implementation of the facility improving approach is simulated with respect to a plurality of the facility improving approaches.

According to the present configuration, simulation results can be obtained with respect to a plurality of the facility improving approaches. Accordingly, for example, by comparing the plurality of the facility improving approaches, merits and demerits of each facility improving approach can be effectively elucidated. Therefore, a request of an owner, manager or the like of the steam-using facility can be easily affected based on the search for the facility improving approach, and accordingly, it becomes possible to further efficiently search for a facility improving approach that is effective in overall improvement of the steam-using facility.

In an eleventh aspect of the present invention, in the improving simulation, the predicted steam usage state of the steam-using facility after implementation of the facility improving approach is simulated with respect to one or more facility improving approach arbitrarily selected from a plurality of the facility improving approaches.

According to the present configuration, simulation results can be obtained with respect to arbitrarily selected facility improving approaches, while eliminating a facility improving approach that is not required to be simulated, such as a facility improving approach which cannot be implemented due to a contract or the like by the owner, manager or the like of the steam-using facility, from a subject of the search, among a plurality of the facility improving approaches. Therefore, it becomes possible to further efficiently search for a facility improving approach that is effective in overall improvement of the steam-using facility.

In a twelfth aspect of the present invention, in the improving simulation, the predicted steam usage state of the steam-using facility after implementation of the facility improving approach is simulated with respect to a combined facility improving approach obtained by combining a plurality of the facility improving approaches.

According to the present configuration, the combined facility improving approach obtained by combining a plurality of the facility improving approaches is a subject of the search, and thus variations in the facility improving approaches which is a subject of the search can be increased. Therefore, it becomes possible to further efficiently search for a facility improving approach that is effective in overall improvement of the steam-using facility.

It should be noted that the facility improving approaches to be combined into the combined facility improving approach are not limited to all of the assumed facility improving approaches, and alternatively, they may be a portion selected from the plurality of the assumed facility improving approaches.

BRIEF DESCRIPTION OF DRAWINGS

FIG. 7 illustrates an output screen image.

BEST MODE FOR CARRYING OUT THE INVENTION

Figure 1:
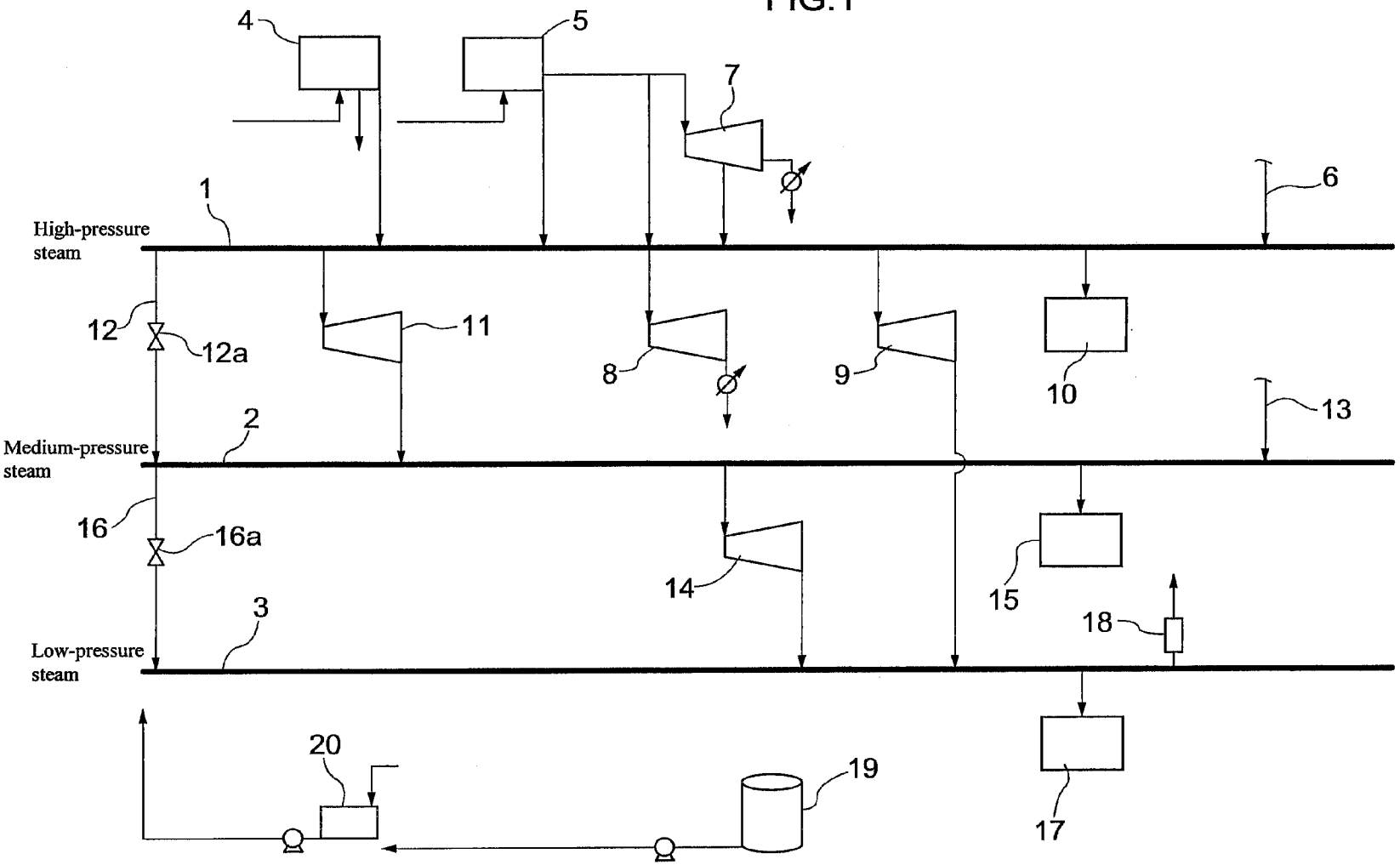
FIG. 1 is a configuration diagram showing a steam-using facility.

FIG. 1 shows an entire configuration of a plant as one example of a steam-using facility, in which steam at appropriate pressure is sent to various steam-using devices, through a high-pressure steam pipe 1 configured to feed steam at high pressure, a medium-pressure steam pipe 2 configured to feed steam at medium pressure, and a low-pressure steam pipe 3 configured to feed steam at low pressure.

To the high-pressure steam pipe 1, steam at high pressure is supplied from a first boiler 4, a second boiler 5 and a high-pressure steam supply channel 6 led from other channels, all as steam supply means. Steam at high pressure supplied to the high-pressure steam pipe 1 is then supplied to a second steam turbine power generator 11, a first high-pressure steam turbine 8, a second high-pressure steam turbine 9, and a plurality of high-pressure steam generators 10, all connected to the high-pressure steam pipe 1 as steam-using devices, and used therein.

Between the second boiler 5 and the high-pressure steam pipe 1, a first steam turbine power generator 7 is arranged in parallel, at which a portion or the entirety of the steam at high pressure from the second boiler 5 is used to generate electricity, and from which steam at high pressure now depressurized in the electric generation is supplied to the high-pressure steam pipe 1.

A first decompression supply channel 12 is for depressurizing the steam at high pressure in the high-pressure steam pipe 1 and supplying the depressurized steam as steam at medium pressure to the medium-pressure steam pipe 2. A portion of the steam in the high-pressure steam pipe 1 is appropriately supplied to the medium-pressure steam pipe 2 by opening and closing a control valve 12*a* disposed on the first decompression supply channel 12.

The steam at high pressure supplied from the second boiler 5 to the second steam turbine power generator 11 is depressurized to steam at medium pressure by being used in electric generation in the second steam turbine power generator 11, and then supplied to the medium-pressure steam pipe 2. In addition, the steam at high pressure supplied from the high-pressure steam pipe 1 to the second high-pressure steam turbine 9 is depressurized to steam at low pressure by being used in the second high-pressure steam turbine 9, and then supplied to the low-pressure steam pipe 3.

To the medium-pressure steam pipe 2, steam at medium pressure is supplied from the first decompression supply channel 12, the second steam turbine power generator 11 and a medium-pressure steam supply channel 13 led from other channels. Steam at medium pressure supplied to the medium-pressure steam pipe 2 is then supplied to a medium-pressure steam turbine 14 and a plurality of medium-pressure steam generators 15, all connected to the medium-pressure steam pipe 2 as steam-using devices, and used therein.

A second decompression supply channel 16 is for depressurizing the steam at medium pressure in the medium-pressure steam pipe 2 and supplying the depressurized steam as steam at low pressure to the low-pressure steam pipe 3. A portion of the steam in the medium-pressure steam pipe 2 is appropriately supplied to the low-pressure steam pipe 3 as steam at low pressure by opening and closing a pressure reducing valve 16*a* disposed on the second decompression supply channel 16. In addition, the steam at medium pressure supplied from the medium-pressure steam pipe 2 to the medium-pressure steam turbine 14 is depressurized to steam at low pressure by being used in the medium-pressure steam turbine 14, and then supplied to the low-pressure steam pipe 3.

To the low-pressure steam pipe 3, steam at low pressure is supplied from the second high-pressure steam turbine 9 and the medium-pressure steam turbine 14. Steam at low pressure supplied to the low-pressure steam pipe 3 is then supplied to a low-pressure steam generator 17 connected to the low-pressure steam pipe 3, and used therein. In addition, excessive steam at low pressure in the low-pressure steam pipe 3 is discharged as unnecessary steam from the system through a vent pipe 18.

Finally, water of vapor condensation generated from the steam used in the steam-using devices 10,15,17 and water of vapor condensation generated during the supply process in the steam supply pipes 1 to 3 is sent to a condensed water tank 19, and after being heated appropriately by a heater 20 as the low-pressure steam generator 17, the heated water is returned to the boilers 4,5.

Figure 2:
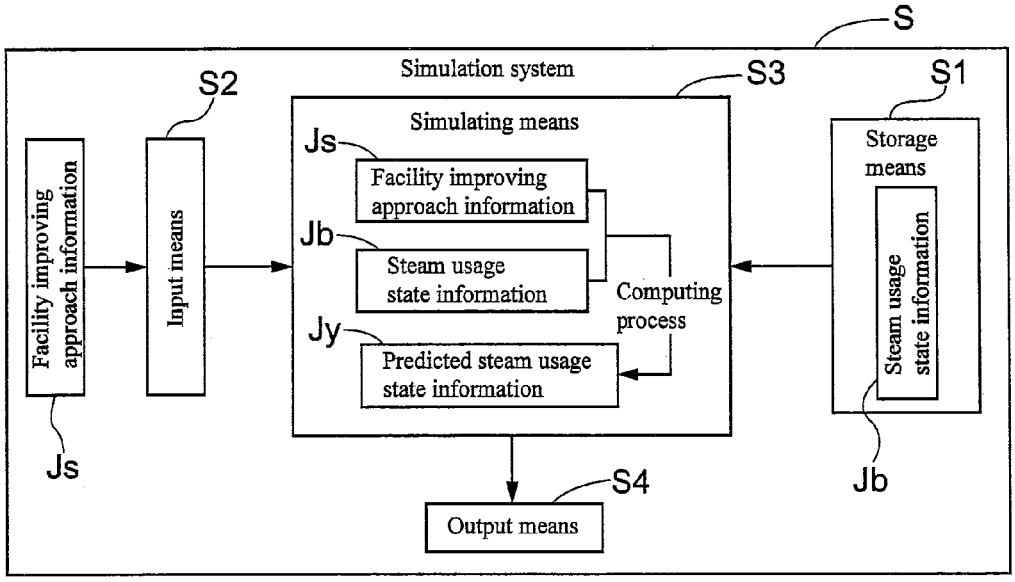
FIG. 2 is a configuration diagram showing a simulation system.

FIG. 2 is a configuration of a steam-using facility simulation system S used for searching for an approach for improving facility, such as the plant as described above. The simulation system S is composed of, for example, a computer and peripheral devices thereof.

The simulation system S includes: a storage means S1 configured to store steam usage state information Jb of the plant; an input means S2 to which facility improving approach information Js regarding the plant is input; a simulating means S3 configured to compute predicted steam usage state information Jy of the plant after implementation of the improving approach, based on the steam usage state information Jb of the plant stored in the storage means S1 and the facility improving approach information Js input to the input means S2; and an output means S4 configured to output the predicted steam usage state information Jy of the plant computed by the simulating means S3.

The storage means S1 is formed of a hard disc built in a computer or the like. The storage means S is configured to store information that enables an assessment of the steam usage state, including: whether or not the steam supply pressure is appropriate from a viewpoint of an entire balance of the plant; whether or not the steam supply method is appropriate; how a discharge of water of vapor condensation is performed; and whether or not the water of vapor condensation is effectively sent to a recycling system, such as boiler. Examples of the steam usage state information Jb (see FIGS. 1 and 2) stored in the storage means S1 include: information (e.g., flow rate, pressure and temperature) of major portions of the steam, such as steam generated by each of the boilers 4,5, steam supplied from each of the boilers 4,5 and each of the steam supply channels 6,13 and the like to each of the steam pipes 1 to 3, steam used by each of the steam-using devices 7 to 11,14,15,17,20, steam supplied from each of the steam-using devices 7 to 11,14,15,17,20 to each of the steam pipes 1 to 3, steam discharged from the vent pipe 18, steam supplied from each of the decompression supply pipes 12,16 to each of the steam pipes 1 to 3, and unknown steam which is a sum of a passed steam loss in steam traps (piping trap, trace trap and the like) connected to each of the steam pipes 1 to 3 and condensation in each of the pipes; information regarding specification of each of the components 1 to 20; information regarding electrical generation amount at each of the steam turbine power generators 7,11; and information regarding power demand and received power amount of the plant.

It should be noted that, in the present embodiment, the steam usage state information Jb is input to the storage means S1, through a key board, a CD-ROM drive or a mouse connected to the computer, or alternatively, through a specialized terminal or the like provided in the computer for a diagnostic device.

Figure 5:
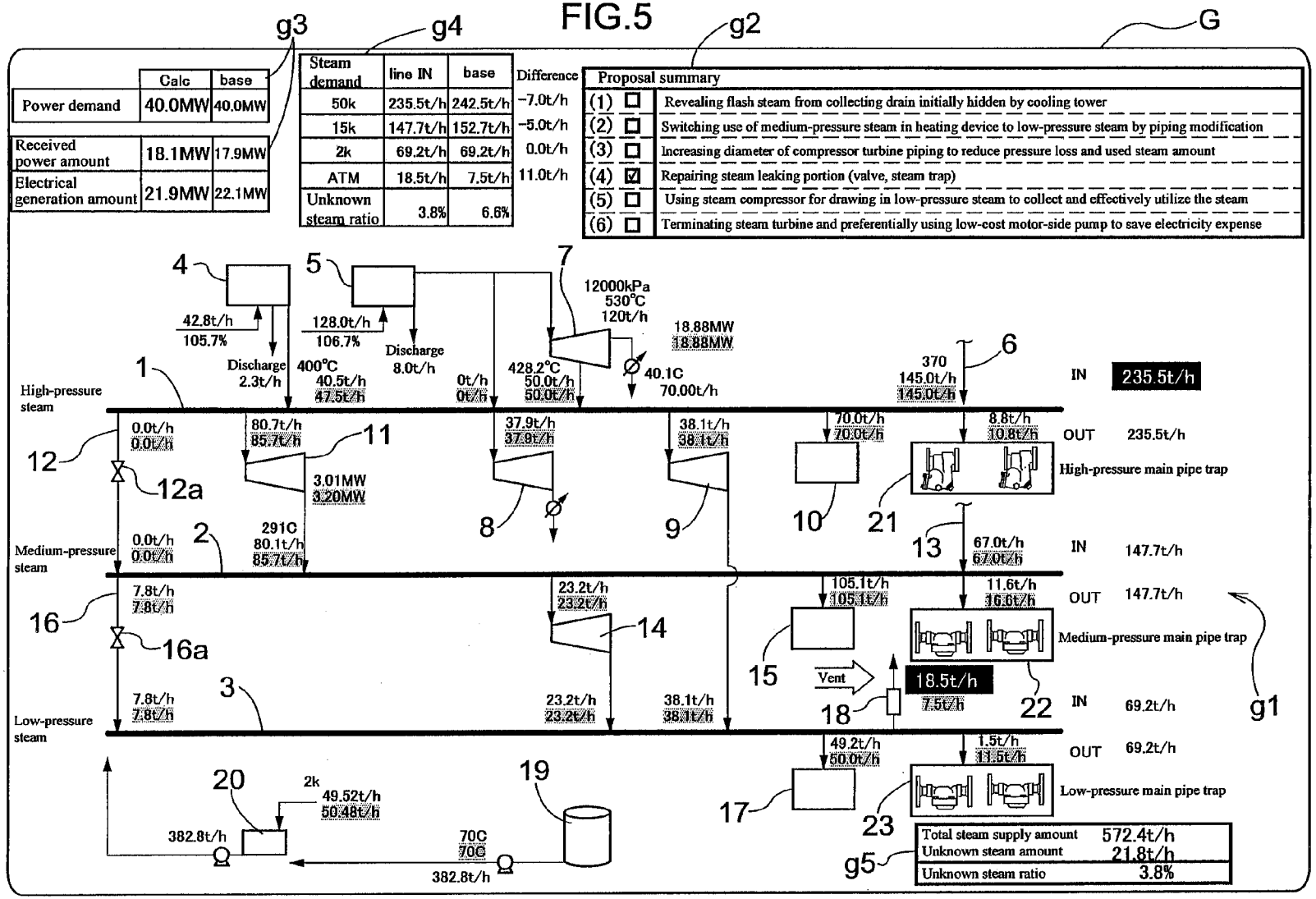
FIG. 5 illustrates an output screen image.

The input means S2 is composed of a key board, a CD-ROM drive or a mouse connected to the computer, and is configured to receive an input of a single or multiple pieces of the facility improving approach information Js, which is selected by a searcher or the like based on the steam usage state information Jb. For the facility improving approach, specific approaches are assumed, such as those illustrated as items (1) to (6) in an improving approach display field g2 (see FIG. 5), which will be described later.

The simulating means S3 is composed of a CPU and the like, which is built in the computer and configured to implement a simulation program stored in the storage means S1. When a single piece of the facility improving approach information Js is input to the input means S2 as shown in FIG. 2, the simulating means S3 computes the predicted steam usage state information Jy of the plant after implementation of the improving approach, based on the single facility improving approach information Js and the steam usage state information Jb stored in the storage means S1.

When multiple pieces of the facility improving approach information Js are input to the input means S2, the simulating means S3 receives one or more pieces of the facility improving approach information Js selected by a searcher.

Figure 3:
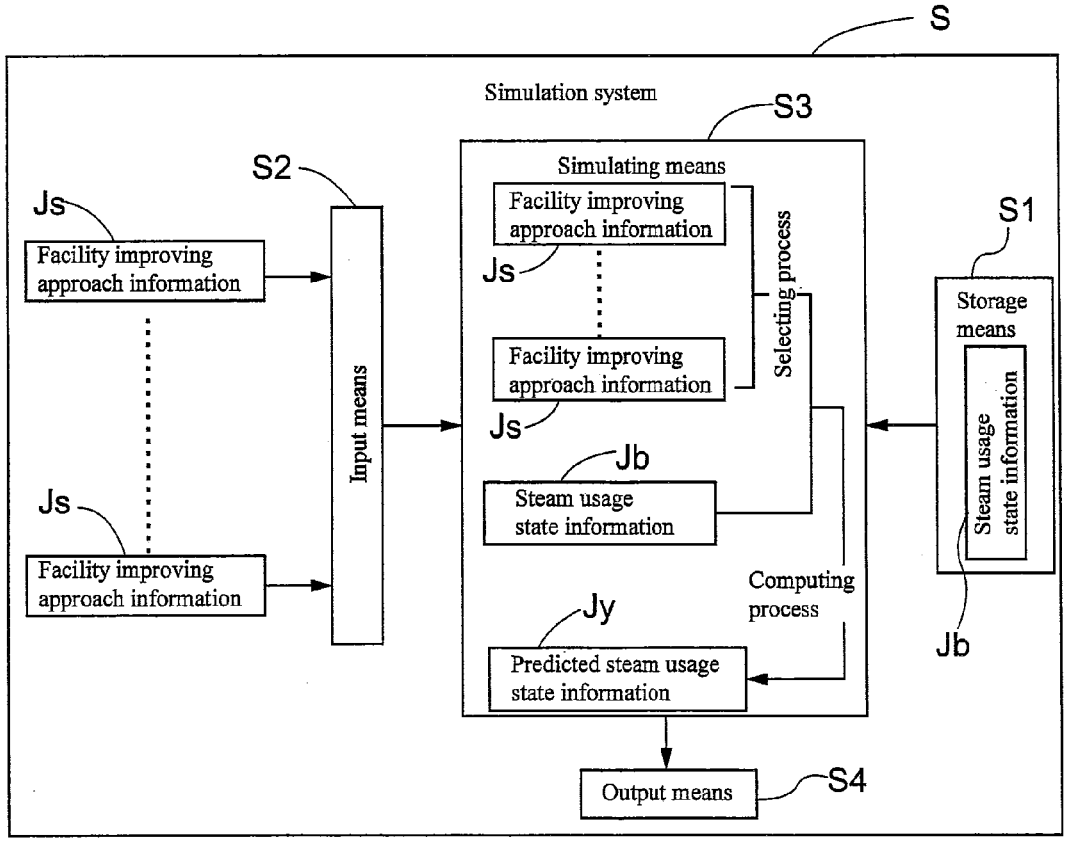
FIG. 3 is a configuration diagram showing a simulation system.

When a single piece of the facility improving approach information Js is selected during the selecting process, as shown in FIG. 3, a computing process is performed in which the predicted steam usage state information Jy is computed based on this single piece of the facility improving approach information Js and the steam usage state information Jb.

Examples of the predicted steam usage state information Jy as information after implementation of the facility improving approach include: information (e.g., flow rate, pressure and temperature) of major portions of steam, such as steam generated by each of the boilers 4,5, steam supplied from each of the boilers 4,5 and each of the steam supply channels 6,13 and the like to each of the steam pipes 1 to 3, steam used by each of the steam-using devices 7 to 11,14,15,17,20, steam supplied from each of the steam-using devices 7 to 11,14,15,17,20 to each of the steam pipes 1 to 3, steam discharged from the vent pipe 18, steam supplied from each of the decompression supply pipes 12,16 to each of the steam pipes 1 to 3, and unknown steam which is a sum of a passed steam loss in steam traps connected to each of the steam pipes 1 to 3 and condensation in each of the pipes; information regarding electrical generation amount at each of the steam turbine power generators 7,11; and information regarding power demand and received power amount of the plant.

Figure 4:
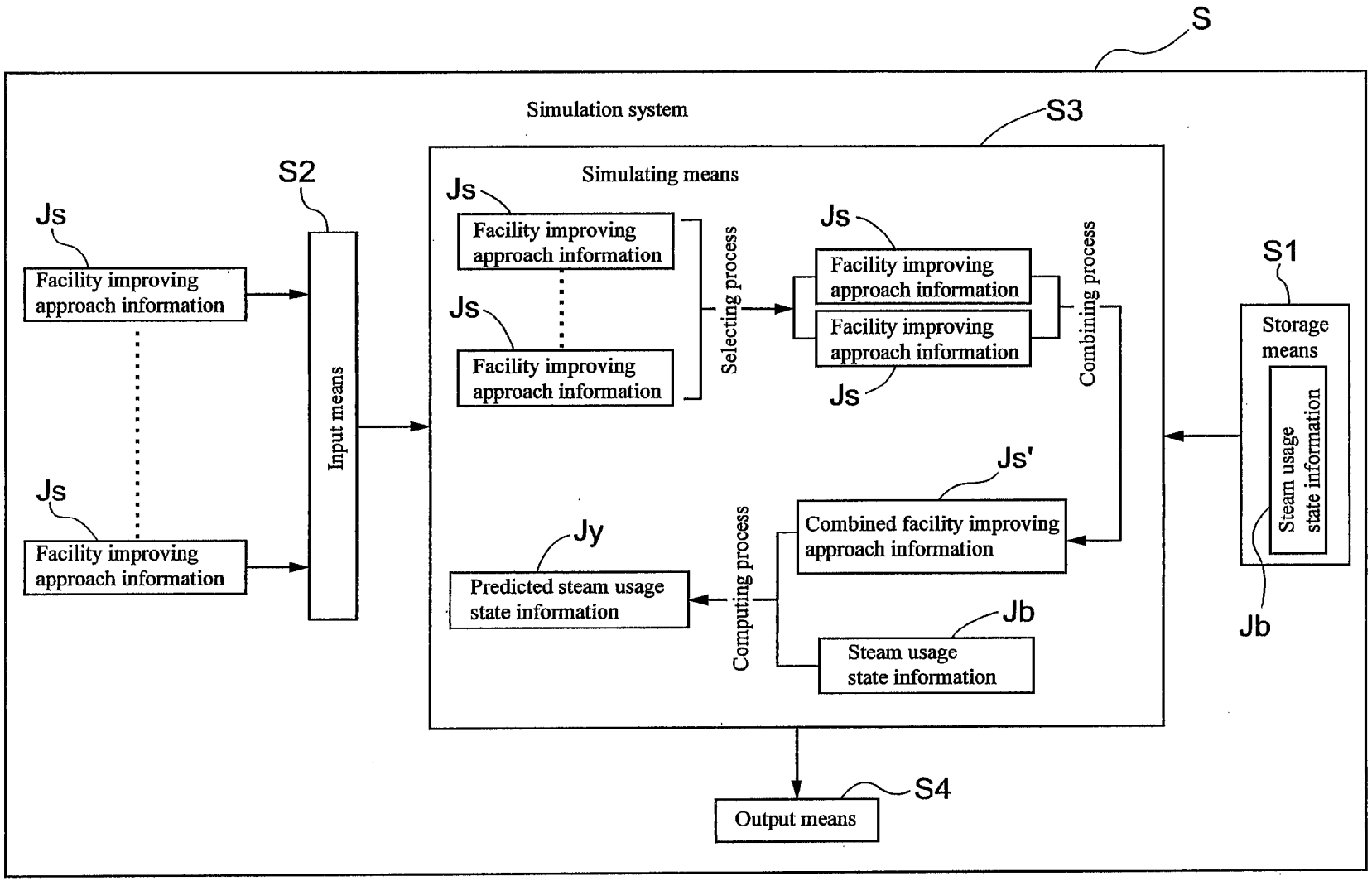
FIG. 4 is a configuration diagram showing a simulation system.

Alternatively, when two or more pieces of the facility improving approach information Js,Js . . . are selected during the selecting process, as shown in FIG. 4, a combining process is performed in which the selected multiple pieces of the facility improving approach information Js,Js . . . are combined to give combined facility improving approach information Js', and then a computing process is performed in which the predicted steam usage state information Jy is computed based on this combined facility improving approach information Js' and the steam usage state information Jb.

In the present embodiment, the selecting process is performed by a searcher through selecting a specific piece of facility improving approach information Js from among the multiple pieces of the facility improving approach information Js input to the input means S2, on a display screen output by the output means S4 (which will be described later) using a mouse or the like connected to the computer.

The output means S4 is composed of a display or the like connected to the computer. In the present embodiment, for example, when the item "(4) Repairing steam leaking portion (valve, steam trap)" is selected from among multiple pieces of the facility improving approach information Js,Js . . . (the items (1) to (6) in the improving approach display field g2 in FIG. 5) input to the input means S2, the output means S4 outputs an image G shown in FIG. 5 as a simulation result by the simulating means S3.

In the image G, there are displayed: a facility configuration display field g1 showing an entire configuration of the plant; the improving approach display field g2 showing facility improving approach input to the input means S2; an electric power display field g3 showing power demand, received power amount and electrical generation amount of the plant; a steam demand etc display field g4 showing steam demand and the like of the plant; and a total steam supply amount etc display field g5 showing total steam supply amount and the like of the plant.

In addition to display bodies 1 to 20 each representing the component described with reference to FIG. 1, the facility configuration display field g1 also shows bodies 21 to 23 which are assumed as destinations of unknown steam amount in corresponding steam pipes 1 to 3, the unknown steam amount for each pipe being obtained as a sum total value of a passed steam loss amount in various steam traps (piping trap, trace trap and the like) connected to the corresponding steam pipe and an amount of steam loss caused by condensation during feeding through the corresponding steam pipe.

In the vicinity of each of the display bodies 1 to 23 in the facility configuration display field g1, information before and after implementation of the facility improving approach is shown in an upper-lower double row style (upper row: information after implementation of the improving approach, lower row: information before implementation of the improving approach), which information may include vapor amount (t/h) passing through the corresponding display body, and if desired, steam temperature (° C.), electrical generation amount (MW) and the like.

In the electric power display field g3, information before and after implementation of the facility improving approach is shown in a table in a right-left double column style (left column: information after implementation of the improving approach, right column: information before implementation of the improving approach) with respect to power demand, received power amount and electrical generation amount of the plant (MW).

In the steam demand etc display field g4, information before and after implementation of the facility improving approach is shown in a table in a right-left double column style (left column: predicted information after implementation of the improving approach, right column: information before implementation of the improving approach) with respect to steam demand (t/h) of the plant, vapor amount at high pressure (in the present embodiment, displayed as "50 k"), vapor amount at medium pressure (in the present embodiment, displayed as "15 k"), vapor amount at low pressure (in the present embodiment, displayed as "2 k"), vapor amount discharged from the vent pipe 18 (in the present embodiment, displayed as "ATM") and unknown steam ratio (%) of the plant.

In the improving approach information display field g2, information of facility improving approach is displayed by category using characters, based on multiple pieces of the facility improving approach information Js input to the input means S2, along with checkboxes each indicating whether or not the corresponding facility improving approach is selected for implementing the selecting process in the simulating means S3. In other words, in the improving approach information display field g2, the multiple pieces of the facility improving approach information by category input to the input means S2 is output in such a manner that the piece of the facility improving approach information by category used in the computation by the simulating means S3 is distinguishable (specifically, visually distinguishable) from the multiple pieces of the facility improving approach information by category input to the input means S2.

In the total steam supply amount etc display field g5, total steam supply amount (t/h) of the plant after implementation of the improving approach, unknown steam amount (t/h), and unknown steam ratio (%) (i.e., a ratio of an unknown steam amount to a total steam supply amount) are shown.

To put it another way, when a searcher selects the item (4) as facility improving approach (specifically, a searcher clicks a checkbox for the item (4) from among the improving approach information display field g2), the simulating means S3 selects the facility improving approach information Js related to the item (4), and based on the selected facility improving approach information Js related to the item (4) and the steam usage state information Jb, computes the predicted steam usage state information Jy after implementation of the improving approach.

In the present embodiment, for example, in a case where the steam leakage is eliminated, the simulating means S3 computes that vapor amount related to each of the display bodies 21 to 23 (i.e., unknown steam amount of each of the steam pipes 1 to 3) is reduced, and in association with this, computes that amounts of vapor supplied from the first boiler 4 to the high-pressure steam pipe 1, vapor supplied to the first steam turbine power generator 7, and vapor supplied from the second steam turbine power generator 11 to the medium-pressure steam pipe 2 are reduced, and further computes that the total steam supply amount is reduced by 12 (t/h), the unknown steam amount is reduced by 17 (t/h), and the unknown steam ratio is reduced. Then, the output means S4 outputs the image G shown in FIG. 5 as a simulation result by the simulating means S3.

Figure 6:
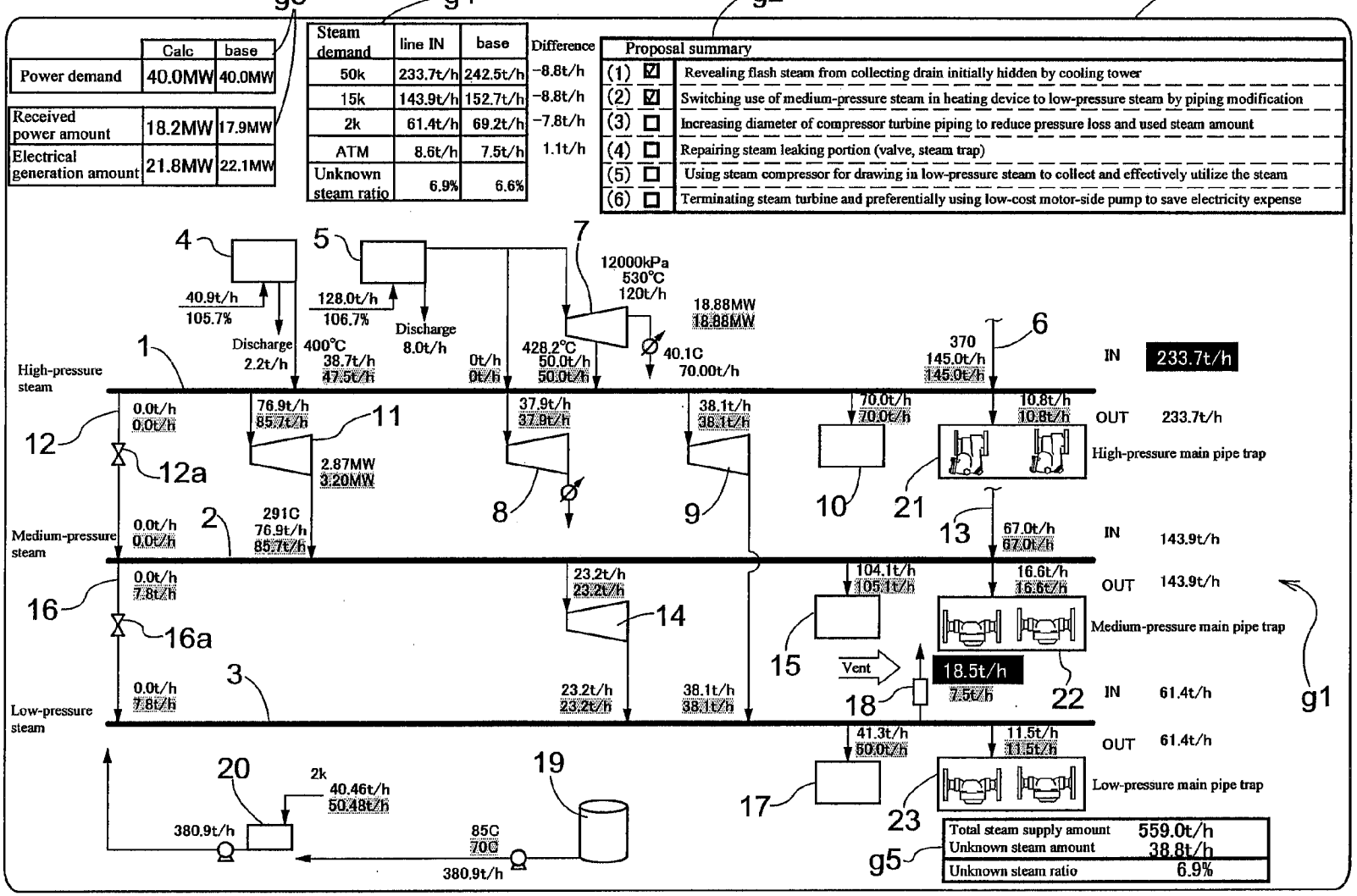
FIG. 6 illustrates an output screen image.

Alternatively, when a searcher selects the items "(1) Revealing flash steam from collecting drain initially hidden by cooling tower" and "(2) Switching use of medium-pressure steam in heating device to low-pressure steam by piping modification" as facility improving approach, the simulating means S3 first selects the facility improving approach information Js,Js of the items (1), (2) and combines them to obtain the combined facility improving approach information Js', and based on this combined facility improving approach information Js' and the steam usage state information Jb, computes the predicted steam usage state information Jy after implementation of the improving approach. Then, the output means S outputs the image G shown in FIG. 6 as a simulation result by the simulating means S3.

When a searcher selects the item "(5) Using steam compressor for drawing in low-pressure steam to collect and effectively utilize the steam" in addition to the items (1), (2) as facility improving approach, the simulating means S3 first selects the facility improving approach information Js,Js,Js of the items (1), (2), (5) and combines them to obtain the combined facility improving approach information Js', and based on this combined facility improving approach information Js' and the steam usage state information Jb, computes the predicted steam usage state information Jy after implementation of the improving approach. Then, the output means S4 outputs the image G shown in FIG. 7 as a simulation result.

Figure 8:
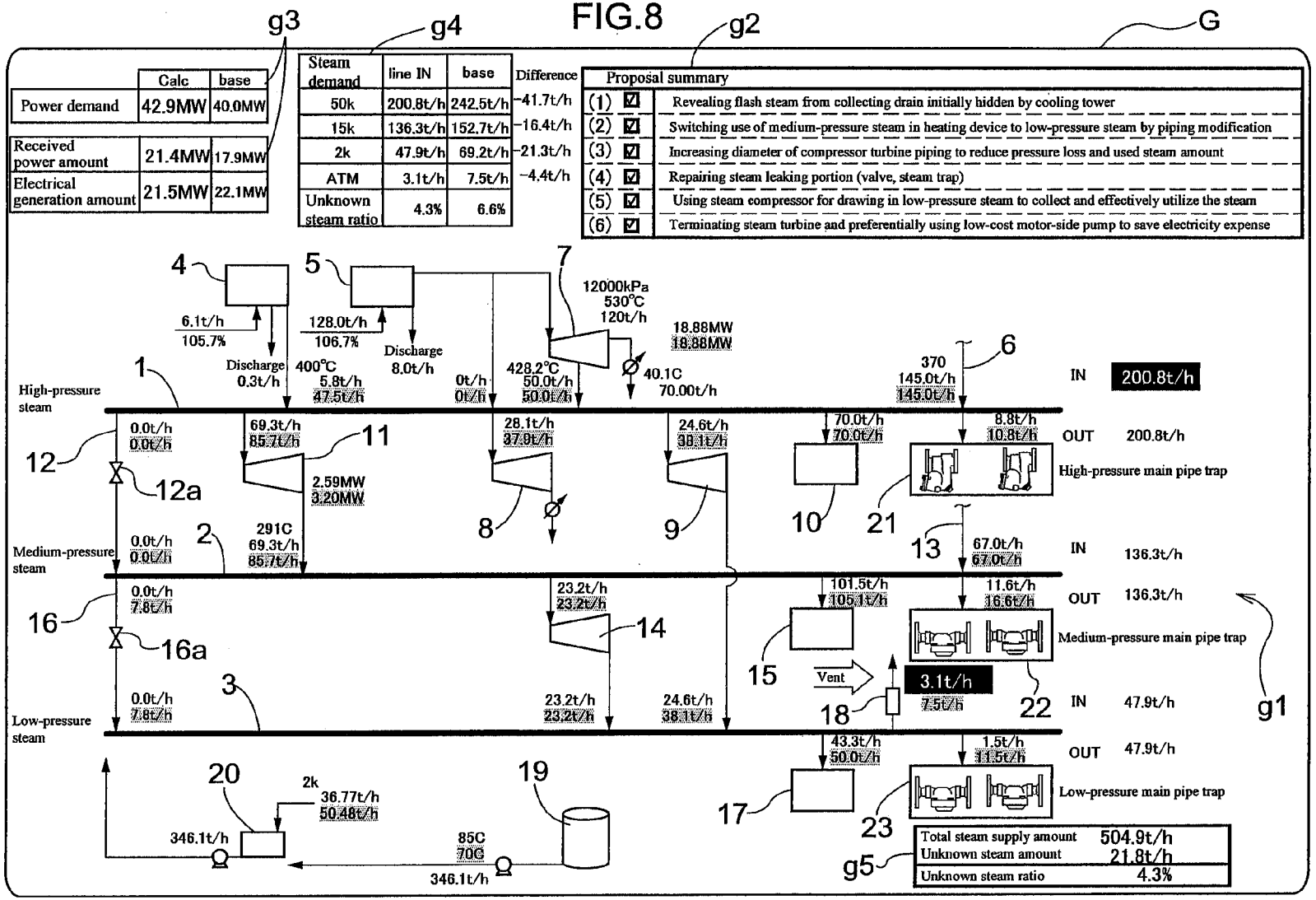
FIG. 8 illustrates an output screen image.

When a searcher selects the items "(3) Increasing diameter of compressor turbine piping to reduce pressure loss and used steam amount" and "(6) Terminating steam turbine and preferentially using low-cost motor-side pump to save electricity expense," in addition to the items (1), (2), (4), (5) as facility improving approach, the simulating means S3 first selects the facility improving approach information Js,Js . . . of the items (1) to (6) and combines them to obtain the combined facility improving approach information Js', and based on this combined facility improving approach information Js' and the steam usage state information Jb, computes the predicted steam usage state information Jy after implementation of the improving approach. Then, the output means S4 outputs the image G shown in FIG. 8 as a simulation result.

To sum up, the simulating means S3 is configured as any one of the followings: to compute the predicted steam usage state information Jy based on multiple pieces of the facility improving approach information Js input to the input means S2; to select one or more pieces of the facility improving approach information Js from among multiple pieces of the facility improving approach information Js input to the input means S2 and to compute the predicted steam usage state information Jy based on the selected facility improving approach information Js; or to combine multiple pieces of the facility improving approach information Js,Js . . . input to the input means S2 to obtain the combined facility improving approach information Js' and to compute the predicted steam usage state information Jy based on the combined facility improving approach information Js'.

In addition, the output means S4 is configured to output, at the same time, the facility improving approach information by category used in the computation by the simulating means S3, the predicted steam usage state information Jy computed by the simulating means S3 and the steam usage state information Jb stored in the storage means, in such a manner that the facility improving approach information by category used in the computation by the simulating means S3 is distinguishable from multiple pieces of the facility improving approach information by category input to the input means S2.

Next, the method for searching an approach for improving a facility according to the present invention will be described.

First, with respect to the target plant, a searcher performs a current situation survey on the facility to assess a steam usage state of the plant. In this current situation survey on the facility, the searcher actually diagnoses the steam pipes 1 to 3 as well as steam traps, steam-using devices and the like connected to the steam pipes, using a diagnostic device or the like, or predicts a deterioration state using a blueprint or the like. In accordance with the diagnosis result, the searcher obtains the steam usage state information Jb as described above. The searcher then assesses the steam usage state of the plant based on the steam usage state information Jb.

Preferable examples of the steam usage state to be assessed include: whether or not the steam supply pressure is appropriate from a viewpoint of an entire balance of the plant; whether or not the steam supply method is appropriate; how a discharge of water of vapor condensation is performed; and whether or not the water of vapor condensation is effectively sent to a recycling system, such as boiler.

Second, the searcher inputs the steam usage state information Jb obtained by the current situation survey on the facility, to the simulation system S. The steam usage state information Jb input to the simulation system S is stored in the storage means S1.

In accordance with the steam usage state or the steam usage state information Jb, the searcher assumes a facility improving approach to be realized based on his/her experience or the like, and inputs the facility improving approach information Js to the input means S2 of the simulation system S.

Then, by using the simulation system S, the searcher performs an improving simulation that simulates the predicted steam usage state information Jy after implementation of the improving approach, and based on the simulation result, conducts a search of the appropriate facility improving approach information Js, in consideration of the predicted steam usage state regarding an item corresponding to the steam usage state assessed through the current situation survey on the facility.

Specifically, to the owner, manager or the like of the plant, the searcher may sequentially show simulation results regarding the multiple pieces of the facility improving approach information Js (i.e., the image G output by the output means S4 as a simulation result by the simulating means S3), or simulation results regarding the combined facility improving approach information Jy' obtained by combining multiple pieces of the facility improving approach information Js, and may search for an appropriate facility improving approach while taking wishes of the owner into consideration.

Other Embodiments

Next, other embodiments will be described below.

In the embodiment described above, the output means S3 outputs both the steam usage state information Jb before implementation of the facility improving approach and the predicted steam usage state information Jy after implementation of the facility improving approach at the same time, as the simulation result to be output with respect to the facility improving approach information Jy. Alternatively, when the simulation is repeated multiple times, instead of outputting the steam usage state information Jb before implementation of the facility improving approach, or in addition to outputting the same, the predicted steam usage state information based on the simulation immediately before may be output at the same time.

The output means S4 outputs the image G on the screen of the display or the like shown in the embodiment described above, and alternatively, may output (e.g., print) the image G on a paper or the like.

A method for displaying the image G output by the output means S4 is not limited to one in the embodiment described above, and various displaying methods can be applied.

A method for storing the steam usage state information Jb in the storage means S1 is not limited to one in the embodiment described above, and various methods can be applied.

INDUSTRIAL APPLICABILITY

The present invention is applicable to management of various steam-using facilities using steam, such as chemical plant.

The invention claimed is:

1. A steam-using facility simulation system comprising:

storage means configured to store steam usage state information of a steam-using facility;

input means to which facility improving approach information of the steam-using facility is input;

simulating means configured to compute predicted steam usage state information of the steam-using facility after implementation of an improving approach based on the steam usage state information of the steam-using facility stored in the storage means and the facility improving approach information input to the input means; and output means configured to output the predicted steam usage state information of the steam-using facility computed by the simulating means.

2. The system according to claim 1, wherein the simulating means is configured to compute the predicted steam usage state information of the steam-using facility after implementation of the improving approach based on multiple pieces of the facility improving approach information input to the input means.

3. The system according to claim 2, wherein the output means is configured to output the steam usage state information of the steam-using facility stored in the storage means and at the same time the predicted steam usage state information of the steam-using facility computed by the simulating means.

4. The system according to claim 1, wherein the simulating means is configured to select one or more pieces of the facility improving approach information from among multiple pieces of the facility improving approach information input to the input means, and to compute the predicted steam usage state information of the steam-using facility after implementation of the improving approach based on the selected facility improving approach information.

5. The system according to claim 4, wherein the output means is configured to output the steam usage state information of the steam-using facility stored in the storage means and at the same time the predicted steam usage state information of the steam-using facility computed by the simulating means.

6. The system according to claim 1, wherein the simulating means is configured to combine multiple pieces of the facility improving approach information input to the input means to obtain combined facility improving approach information, and to compute the predicted steam usage state information of the steam-using facility after implementation of the improving approach based on the combined facility improving approach information.

7. The system according to claim 6, wherein the output means is configured to output the steam usage state information of the steam-using facility stored in the storage means and at the same time the predicted steam usage state information of the steam-using facility computed by the simulating means.

8. The system according to claim 1, wherein the output means is configured to output the facility improving approach information by category used in the computation by the simulating means and at the same time the predicted steam usage state information of the steam-using facility computed by the simulating means.

9. The system according to claim 8, wherein the output means is configured to output multiple pieces of the facility improving approach information by category input to the input means in such a manner that a piece of the facility improving approach information by category used in the computation by the simulating means from among multiple pieces of the facility improving approach information by category input to the input means is distinguishable.

10. The system according to claim 9, wherein the output means is configured to output the steam usage state information of the steam-using facility stored in the storage means and at the same time the predicted steam usage state information of the steam-using facility computed by the simulating means.

11. The system according to claim 8, wherein the output means is configured to output the steam usage state information of the steam-using facility stored in the storage means and at the same time the predicted steam usage state information of the steam-using facility computed by the simulating means.

12. The system according to claim 1, wherein the output means is configured to output the steam usage state information of the steam-using facility stored in the storage means and at the same time the predicted steam usage state information of the steam-using facility computed by the simulating means.

13. A method for searching for an approach for improving a steam-using facility comprising steps of:

diagnosing the steam-using facility, and based on a diagnosis result, conducting a current situation survey on the steam-using facility for assessing a steam usage state of the steam-using facility;

assuming a facility improving approach to be realized based on the steam usage state of the steam-using facility assessed through the current situation survey on the facility, and conducting an improving simulation for simulating a predicted steam usage state of the steam-using facility after implementation of the facility improving approach; and searching for an appropriate facility improving approach based on the predicted steam usage state of the steam-using facility obtained by the improving simulation.

14. The method according to claim 13, wherein any one of the following is assessed as the steam usage state of the steam-using facility through the current situation survey:

(a) whether or not a steam supply pressure is appropriate from a viewpoint of an entire balance of the steam-using facility;

(b) whether or not a steam supply method is appropriate;

(c) how a discharge of water of vapor condensation is performed; and (d) whether or not the water of vapor condensation is effectively fed to a recycling system including a boiler.

15. The method according to claim 14, wherein in the improving simulation, the predicted steam usage state of the steam-using facility after implementation of the facility improving approach is simulated with respect to a combined facility improving approach obtained by combining a plurality of the facility improving approaches.

16. The method according to claim 13, wherein in the improving simulation, the predicted steam usage state of the steam-using facility after implementation of the facility improving approach is simulated with respect to a plurality of the facility improving approaches.

17. The method according to claim 16, wherein in the improving simulation, the predicted steam usage state of the steam-using facility after implementation of the facility improving approach is simulated with respect to a combined facility improving approach obtained by combining a plurality of the facility improving approaches.

18. The method according to claim 13, wherein in the improving simulation, the predicted steam usage state of the steam-using facility after implementation of the facility improving approach is simulated with respect to one or more facility improving approach arbitrarily selected from a plurality of the facility improving approaches.

19. The method according to claim 18, wherein in the improving simulation, the predicted steam usage state of the steam-using facility after implementation of the facility improving approach is simulated with respect to a combined facility improving approach obtained by combining a plurality of the facility improving approaches.

20. The method according to claim 13, wherein in the improving simulation, the predicted steam usage state of the steam-using facility after implementation of the facility improving approach is simulated with respect to a combined facility improving approach obtained by combining a plurality of the facility improving approaches.

* * * * *

UNITED STATES PATENT AND TRADEMARK OFFICE

CERTIFICATE OF CORRECTION

PATENT NO. : 8,447,577 B2
APPLICATION NO. : 12/674023
DATED : May 21, 2013
INVENTOR(S) : Yoshiyasu Fujiwara It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 622 days.

Signed and Sealed this
Eighth Day of September, 2015

Michelle K. Lee

Michelle K. Lee
*Director of the United States Patent and Trademark Office*